US006428941B1

(12) United States Patent
Cheng et al.

(10) Patent No.: US 6,428,941 B1
(45) Date of Patent: Aug. 6, 2002

(54) TONER COMPOSITIONS CONTAINING A STYRENE ACRYLATE COPOLYMER

(75) Inventors: Chieh-Min Cheng, Rochester; Grazyna E. Kmiecik-Lawrynowicz, Fairport; Karen LaMora, Marion, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/722,510

(22) Filed: Nov. 28, 2000

(51) Int. Cl.[7] ..... G03G 9/087
(52) U.S. Cl. ..... 430/109.3; 430/137.14
(58) Field of Search ..... 430/109, 109.3, 430/137.14

(56) References Cited

U.S. PATENT DOCUMENTS

| | | | | | |
|---|---|---|---|---|---|
| 4,956,258 | A | * | 9/1990 | Watanabe et al. | 430/109 |
| 5,397,671 | A | | 3/1995 | Bayley et al. | 430/109 |
| 5,416,166 | A | * | 5/1995 | Yoo et al. | 430/109 |
| 5,849,449 | A | * | 12/1998 | Wilson | 430/109.3 |
| 5,853,942 | A | | 12/1998 | Lin | 430/137 |
| 5,853,943 | A | | 12/1998 | Cheng et al. | 430/137 |

FOREIGN PATENT DOCUMENTS

| | | | | |
|---|---|---|---|---|
| JP | 60-142353 | * | 7/1985 | 430/109 |
| JP | 62-191859 | * | 8/1987 | 430/109 |
| JP | 11-116609 | * | 4/1999 | |

OTHER PUBLICATIONS

Derwent Abstract 86–03927/05 describing attached JP 60–142353, 1986.*
Derwent Abstract 87–274569/39 describing JP 62–191859 (attached to patent), 1987.*
Patent & Trademark English– Translation of JP 62–191859 (Pub. Aug. 1987).*
Japanese Patent Office Machine–Assisted Translation of JP 11–116609 (Pub. 4/99) Apr. 1994.*
US Patent & Trademark Office English–Language Translation of JP 11–116609 (pub. 4/99). Apr. 1999.*

* cited by examiner

*Primary Examiner*—Janis L. Dote
(74) *Attorney, Agent, or Firm*—Oliff & Berridge, PLC

(57) ABSTRACT

A copolymer of styrene and an acrylic ester wherein the acrylic ester has an alkyl group with three or fewer carbons or is an aromatic acrylic ester and may be used to form toner particles having reduced vinyl offset.

8 Claims, 2 Drawing Sheets

TONER COMPOSITIONS CONTAINING A STYRENE ACRYLATE COPOLYMER

BACKGROUND OF THE INVENTION

1. Field of Invention

The invention relates to polymer particles, particularly latex polymer particles, that may be used to form toner. The resulting toners can be selected for known electrophotographic imaging and printing processes, including digital color processes, and are especially useful for imaging processes, specifically xerographic processes, which usually require high toner transfer efficiency, such as those having a compact machine design without a cleaner or those that are designed to provide high quality colored images with excellent image resolution and signal-to-noise ratio, and image uniformity, and for imaging systems wherein excellent glossy images are generated.

2. Description of Related Art

Numerous processes are known for the preparation of toners. For example, in conventional processes, a resin is melt kneaded or extruded with a colorant, particularly a pigment, and the product thereof is micronized and pulverized to provide toner particles. The toner particles formed by this process generally have an average volume particle diameter of from about 7 microns to about 20 microns and a broad geometric size distribution of from about 1.4 to about 1.7. As a result, it is usually necessary to subject the aforementioned toner particles to a classification procedure such that a geometric size distribution of from about 1.2 to about 1.4 is attained.

There are also several so-called chemical processes for making toner, among them is the aggregation/coalescence process for making toner particles. In this process, narrow particle size distribution can be achieved without classification. In this process, the resin is prepared as a water based dispersion of sub-micron sized polymeric particles (polymeric latex), which are then aggregated with pigment particles of sub-micron size to the desired toner size and are then coalesced to produce pigmented toner particles.

U.S. Pat. No. 5,853,943, which is herein incorporated in its entirety by reference, is directed to a process for preparing a latex polymer by emulsion polymerization. In this process, the latex polymer is formed by first forming a seed polymer. To form toner from the latex polymer, U.S. Pat. No. 5,853,943 discloses blending the latex with a colorant dispersion; heating the resulting mixture at a temperature below or equal to the $T_g$ of the polymer in the latex to form toner sized aggregates; and heating the aggregates at a temperature at or above the $T_g$ of the polymer to coalesce or fuse the components of the aggregates.

A wide variety of polymer types are used in forming the polymer particles of toner. The polymers include both homopolymeric and copolymeric compositions, such as styrene-butadiene-acrylic acid copolymers, styrene-butyl acrylate-acrylic acid copolymers and acrylic homopolymers.

By selecting various homopolymers and copolymers, toners can be generated that possess specific chemical, mechanical and/or triboelectrical properties. In particular, toners with a low minimum fixing temperature (MFT) are desired to, for example, reduce the energy requirements of the printers and copiers, and to further extend the lifetime of the fuser rolls. However, reducing the MFT of the toner may cause other properties of the toner to be diminished.

The use of styrene-butyl acrylate latexes in emulsion aggregation toners is known. Toners formed with these latexes provide excellent image gloss and reasonably good fusing temperature. However, the transfer of toner from the xerographic images to a plasticized poly(vinyl chloride) (PVC) surface, such as a notebook cover, may occur. Commonly referred to as vinyl offset, this problem is related to the diffusion of plasticizer from the vinyl into the polymer. In particular, shift of a plasticizer such as dioctyl phthalate (DOP) or dibutyl pthalate (DBP) contained in soft PVC to the toner causes the viscosity of the toner to decrease so that the toner adheres to the PVC. The type of plasticizer used in the PVC affects vinyl offset. However, the polymer structure of the toner resin and its molecular weight appears to also be a major factor affecting vinyl offset.

SUMMARY OF THE INVENTION

The present invention is directed to the use of a copolymer of styrene and an acrylic ester as toner resin, particularly as formed by emulsion aggregation. In the present invention, the acrylic ester has an alkyl group with three or fewer carbon atoms or the acrylic ester is an aromatic acrylic ester.

Toner containing the above-mentioned copolymer is particularly useful for low melt/high gloss applications and has superior resistance to vinyl offset as compared to copolymers in which the acrylic ester is a butyl acrylate. However, basic toner characteristics such as tribocharge, image fixing performance and gloss are substantially maintained and/or improved.

DETAILED DESCRIPTION OF EXEMPLARY EMBODIMENTS

Figure 1:
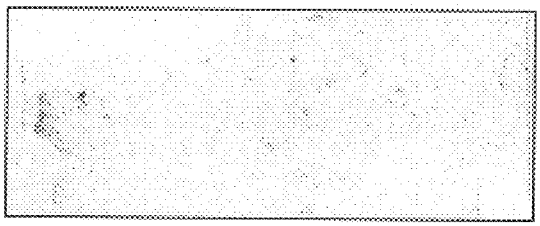
FIG. 1 demonstrates vinyl offset obtained from an embodiment of the present invention comprising a copolymer of styrene and ethyl acrylate.
Figure 2:
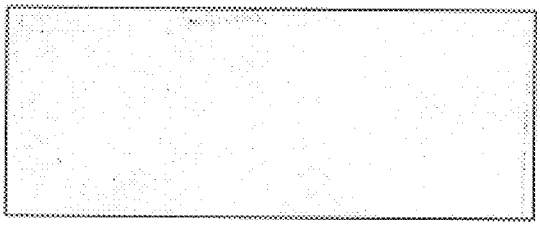
FIG. 2 demonstrates the vinyl offset provided by an embodiment of the present invention in which the resin is a copolymer of styrene, methyl acrylate and ethyl acrylate.
Figure 3:
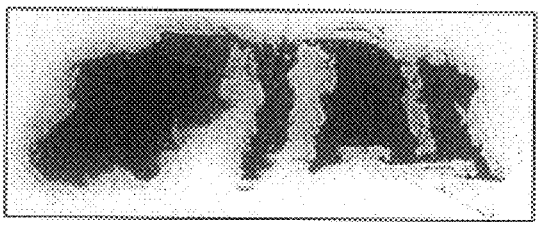
FIG. 3 demonstrates a comparative embodiment in which the resin is a copolymer of styrene and butyl acrylate.
Figure 4:
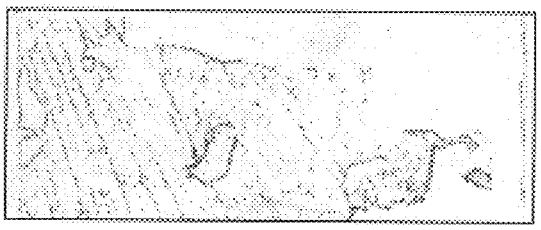
FIG. 4 demonstrates a comparative embodiment in which the resin is a copolymer of styrene and butyl acrylate.
Figure 5:
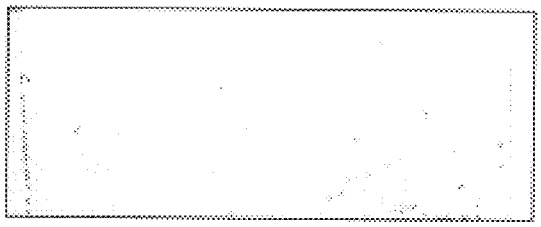
FIG. 5 represents a comparative embodiment in which the resin is a copolymer of styrene and butadiene.
Figure 6:
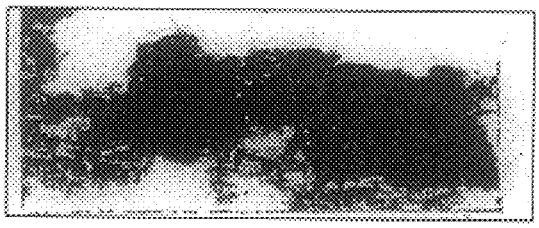
FIG. 6 demonstrates a comparative embodiment in which the resin is a copolymer of styrene and butyl methacrylate.
Figure 7:
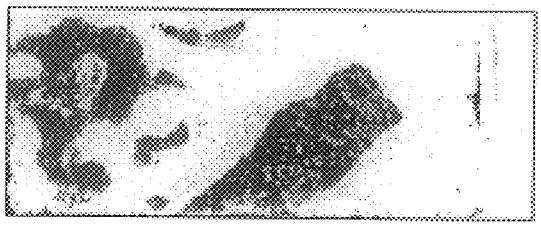
FIG. 7 demonstrates the vinyl offset of a comparative embodiment in which the resin is a copolymer of styrene and butyl methacrylate.
Figure 8:
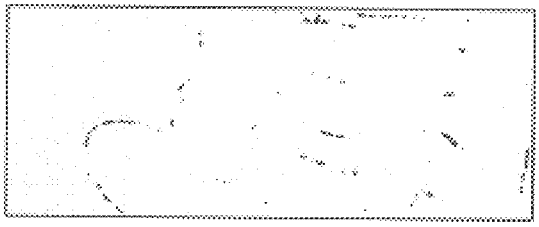
FIG. 8 demonstrates the vinyl offset provided by an embodiment of the present invention in which the resin is a copolymer of styrene, and benzyl methacrylate.

The present invention provides a toner particle comprising colorant and resin, the resin comprising a copolymer comprising styrene and an acrylic ester, the acrylic ester having an alkyl group with three or fewer carbon atoms or being an aromatic acrylic ester.

As used herein, the term "styrene" refers to styrene per se, as well as styrene containing modifications, such as a-methyl styrene, 3-chlorostyrene, 2,5-dichlorostyrene, 4-bromostyrene, 4-tert-butylstyrene, 4-methoxystyrene, vinyl naphthalene, vinyl toluene, and divinyl benzene.

In particular embodiments of the present invention, the acrylic ester of the copolymer has an alkyl group with three or fewer carbon atoms. For the purposes of the present invention, the term "acrylic ester" includes acrylic esters and methacrylic esters. The acrylic ester may therefore be propyl acrylate, propyl methacrylate, ethyl acrylate, ethyl methacrylate, methyl acrylate, methyl methacrylate or mixtures thereof. In embodiments where the acrylic ester includes propyl (meth)acrylate, the propyl (meth)acrylate may be n-propyl (meth)acrylate or isopropyl (meth)acrylate or mixtures thereof.

In another embodiment of the present invention, the acrylic ester of the copolymer may be an aromatic acrylic ester. Preferred aromatic acrylic ester monomers include benzyl acrylate, phenyl acrylate, phenethyl acrylate, benzyl methacrylate or a mixture thereof.

A copolymer of styrene with acrylic ester in toner resin provides a compromise between excellent electrostatic and gloss properties of polystyrene and the desired film forming and adhesive properties of acrylates. The acrylic ester monomers of the present invention offer superior vinyl offset resistance as compared to butyl acrylate.

The acrylic ester monomers can be used in the copolymer of the present invention in amounts of greater than 30 weight percent. In another embodiment, the amount of acrylic ester monomer is from about 30 to about 85 weight percent based on the amount of monomers in the latex.

The styrene is also used in amounts greater than about 15 weight percent based on the amount of monomers in the latex. Preferably, the amount of styrene is from about 15 to about 70 weight percent based on the total weight of the latex.

The copolymer may also comprise a small amount of one or more additional monomers. In a preferred embodiment, the copolymer contains at least 90 weight percent of styrene or acrylic or methacrylic monomers according to the present invention. The copolymer may also contain up to 10 weight percent of other monomers. Suitable monomers include, but are not limited to, vinyl esters of aliphatic acids, ethylenically unsaturated carboxylic acids and known cross-linking agents. Suitable ethylenically unsaturated carboxylic acids include, but are not limited to, itaconic acid, maleic acid, fumaric acid, 2-carboxyethyl acrylate (β-CEA), and the like.

In a particularly preferred embodiment, the acrylic ester includes at least one of methyl acrylate, ethyl acrylate and benzyl acrylate.

The toner of the present invention may be formed by emulsion polymerization. In particular, a multi-stage emulsion polymerization process may be used.

The toner formed may or may not be cross-linked. Any suitable cross-linking agent may be used. Suitable cross-linking agents include, but are not limited to, divinyl benzene, divinyl toluene, diacrylates, dimethacrylates, and the like.

The copolymer of the present invention may be mixed with colorant in order to form toner. Conventional techniques may be used to form toner, such as disclosed in U.S. Pat. No. 5,397,671, the entire disclosure of which is hereby incorporated by reference. For example, the latex polymer may be melt kneaded or extruded with a colorant and the product thereof may be micronized and pulverized to provide toner particles.

Alternatively, the toner of the present invention may be formed by emulsion aggregation techniques. In particular, the process may comprise blending a colorant, preferably a colorant dispersion, more preferably containing a pigment, such as carbon black, phthalocyanine, quinacridone or RHODAMINE B.TM. type, with a latex polymer prepared as illustrated herein and optionally with a flocculate and/or charge additives; heating the resulting flocculate mixture at a temperature below the $T_g$ of the latex polymer, preferably from about 25° C. to about 1° C. below the $T_g$ of the latex polymer, for an effective length of time of, for example, 0.5 hour to about 2 hours, to form toner sized aggregates; subsequently heating the aggregate suspension at a temperature at or above the $T_g$ of the latex polymer, for example from about 60° C. to about 120° C., to effect coalescence or fusion, thereby providing toner particles; and isolating the toner product, such as by filtration, thereafter optionally washing and drying the toner particles, such as in an oven, fluid bed dryer, freeze dryer, or spray dryer.

The latex polymer is generally present in the toner compositions in various effective amounts, such as from about 75 weight percent to about 98 weight percent by weight of the toner. However, other effective amounts of latex polymer may be selected in embodiments.

Colorants include pigments, dyes, and mixtures of pigments with dyes, and the like. The colorant is generally present in the toner in an effective amount of, for example, from about 1 to about 15 weight percent by weight of toner, and preferably in an amount of from about 3 to about 10 weight percent by weight of the toner.

Illustrative examples of colorants, such as pigments, that may be used in the processes of the present invention include, but are not limited to, carbon black, such as REGAL 330.RTM.; magnetites, such as Mobay magnetites MO8029.TM., MO8060.TM.; Columbian magnetites; MAPICO BLACKS.TM. and surface treated magnetites; Pfizer magnetites CB4799.TM., CB5300.TM., CB5600.TM., MCX6369.TM.; Bayer magnetites, BAYFERROX 8600.TM., 8610.TM.; Northern Pigments magnetites, NP-604.TM., NP-608.TM.; Magnox magnetites TMB-100.TM., or TMB-104.TM.; and the like. Colored pigments or dyes, including cyan, magenta, yellow, red, green, brown, blue and/or mixtures thereof, may also be used. Generally, cyan, magenta, or yellow pigments or dyes, or mixtures thereof, are used. The pigment or pigments are generally used as water based pigment dispersions.

Specific examples of pigments include, but are not limited to, SUNSPERSE 6000 TM, FLEXIVERSE TM and AQUATONE TM water based pigment dispersions from SUN Chemicals, HELIOGEN BLUE L6900.TM., D6840.TM., D7080.TM., D7020.TM., PYLAM OIL BLUE.TM., PYLAM OIL YELLOW.TM., PIGMENT BLUE 1.TM. available from Paul Uhlich & Company, Inc., PIGMENT VIOLET 1.TM., PIGMENT RED 48.TM., LEMON CHROME YELLOW DCC 1026.TM., E.D. TOLUIDINE RED.TM. and BON RED C.TM. available from Dominion Color Corporation, Ltd., Toronto, Ontario, NOVAPERM YELLOW FGL.TM., HOSTAPERM PINK E.TM. from Hoechst, and CINQUASIA MAGENTA.TM. available from E.I. DuPont de Nemours & Company, and the like. Examples of magentas include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK.TM., and cyan components may also be selected as pigments in the processes of the present invention.

Flocculates may be used in effective amounts of, for example, from about 0.01 percent to about 10 percent by weight of the toner. Flocculants that may be used include, but are not limited to, polyaluminum chloride (PAC), dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_2$, $C_{15}$, $C_7$ trimethyl ammonium bromides, halide salts of quaternized polyoxyethylalkylamines, dodecylbenzyl triethyl ammonium chloride, MIRAPOL.TM. and ALKAQUAT.TM. available from Alkaril Chemical Company, SANIZOL.TM. (benzalkonium chloride), available from Kao Chemicals, and the like.

Charge additives may also be used in suitable effective amounts of, for example, from 0.1 to 5 weight percent by weight of the toner. Suitable charge additives include, but are not limited to, alkyl pyridinium halides, bisulfates, the charge control additives of U.S. Pat. Nos. 3,944,493; 4,007,293; 4,079,014; 4,394,430 and 4,560,635, which illustrate a toner with a distearyl dimethyl ammonium methyl sulfate charge additive, the entire disclosures of which are hereby incorporated by reference, negative charge enhancing additives like aluminum complexes, and the like.

The following examples illustrate specific embodiments of the present invention. One skilled in the art will recognize that the appropriate reagents and component ratios/concentrations may be adjusted as necessary to achieve specific product characteristics. All parts and percentages are by weight unless otherwise indicated.

EXAMPLES

I. Latex Synthesis

Carboxylated latex (CMC 28442-21) comprises styrene/ethyl acrylate/acrylic acid copolymer of 66:34:6 synthesized via a semi-continuous emulsion polymerization process. This latex containing 42 percent solids with an average particle size of 177 nm was obtained. This latex has a molecular weight (Mw) of 31,000 and a $T_g$ midpoint of 53° C.

Carboxylated latex (CMC 28442-34) comprises styrene/methyl acrylate/ethyl acrylate/acrylic acid copolymer of 58:25:17:6 synthesized via a semi-continuous emulsion polymerization process. This latex containing 42 percent solids with an average particle size of 174 nm was obtained. This latex has a Mw of 28,000 and a $T_g$ midpoint of 54° C.

Carboxylated latex (CMC 28442-2) comprises styrene/benzyl methacrylate/ethyl acrylate/acrylic acid copolymer of 18:82:6 synthesized via a semi-continuous emulsion polymerization process. This latex containing 42 percent solids with an average particle size of 174 nm was obtained. This latex has a Mw of 33,000 and a $T_g$ midpoint of 54° C.

A comparative carboxylated latex (CMC 28442-56) comprises styrene/butyl acrylate/acrylic acid copolymer of 75:25:6 synthesized via a semi-continuous emulsion polymerization process. This latex containing 42 percent solids with an average particle size of 182 nm was obtained. This latex has a Mw of 32,000 and a $T_g$ midpoint of 53° C.

Another comparative carboxylated latex (CMC 28442-70) comprises styrene/butyl acrylate/acrylic acid copolymer of 82:18:6 synthesized via a semi-continuous emulsion polymerization process. This latex containing 42 percent solids with an average particle size of 154 nm was obtained. This latex has a Mw of 24,000 and a $T_g$ midpoint of 57° C.

II. Aggregation/Coalescence

Emulsion/Aggregation (E/A) particles (KLG-306C) were made by aggregation coalescence of latex (28442-21) with a pigment solution of BHD 6000 SUNSPERSE CYAN Pigment. The particle size measured upon completion was 6.7 $\mu$m with a volume GSD of 1.20.

E/A particles (KLG-319C) were made by aggregation coalescence of latex (28442-34) with a pigment solution of BHD 6000 SUNSPERSE CYAN Pigment. The particle size measured upon completion was 7.3 $\mu$m with a volume GSD of 1.18.

E/A particles (KLG-322C) were made by aggregation coalescence of latex (28442-2) with a pigment solution of BHD 6000 SUNSPERSE CYAN Pigment. The particle size measured upon completion was 7.8 $\mu$m with a volume GSD of 1.24.

Comparative E/A particles (KLG-324C) were made by aggregation coalescence of latex (28442-56) with a pigment solution of BHD 6000 SUNSPERSE CYAN Pigment. The particle size measured upon completion was 6.8 $\mu$m with a volume GSD of 1.22.

Comparative E/A particles (KLG-354C) were made by aggregation coalescence of latex (28442-70) with a pigment solution of BHD 6000 SUNSPERSE CYAN Pigment. The particle size measured upon completion was 6.8 $\mu$m with a volume GSD of 1.20.

III. Fusing Evaluation

The above four cyan toner particles were evaluated by forming an image in a Mita copier, and fusing the image using Barcelona fuser to determine the image gloss and minimum fusing temperature. The fusing properties of the toner particles made by either styrene/ethyl acrylate (St/EA) copolymer, styrene/methyl acrylate/ethyl acrylate (St/MA/EA) copolymer or styrene/benzyl methacrylate (St/BzMA) copolymer are almost identical to those made by styrene/butyl acrylate (St/BA) copolymers. Their fusing properties are also very comparable to Constellation conventional polyester toner. The blocking, COT and HOT temperatures of these St/EA, St/MA/EA, or St/BzMA toners are very comparable to St/BA and Constellation toner particles. The gloss of these toners is equivalent to St/BA and Constellation toner particles.

IV. Vinyl Offset Evaluation

Vinyl offset of the toner particles was evaluated at MT&C/SD&MS lab. The E/A toner particles above were fused at 170° C. 5090 (styrene-butadiene), 5100 (styrene-butyl methacrylate) and 1090 (styrene-butyl methacrylate) were used as reference toners. Test images were prepared against FX vinyl (32% DOP) under a load of 10 g/cm$^2$ and heated at 50° C. for 48 hours. A visual ranking scheme similar to FX ranking system was used to assess the offset toner. The two control toners performed as expected. 1090 was the worst for vinyl offset, with 5100 being better and 5090 being the best. The two styrene/nbutyl acrylate (St/BA) toner particles showed vinyl offset, while the toner particles with styrene/ethyl acrylate (St/EA) styrene/methyl acrylate/ethyl acrylate (St/MA/EA), or styrene/benzyl methacrylate (St/BzMA) showed no vinyl offset as 5090 toners. This indicates that E/A toner compositions in accordance with this invention are free of vinyl offset as compared with the current benchmark styrene/butyl acrylate E/A toners.

TABLE 1

Toner Particles - Particle Characteristics and Fusing Properties

| Sample ID | Particle Shape | Mw K | $T_g$ mid ° C. | Size, μm (GSD) | Crease C60 ° C. | Crease C30 ° C. | COT ° C. | HOT ° C. | Gloss $TG_{50}$ ° C. | Peak Gloss Gmax |
|---|---|---|---|---|---|---|---|---|---|---|
| KLG-306C (latex CMC28442-21, St/EA copolymer) | Potato | 31 | 53 | 6.7 (1.20) | 151 | 158 | 135 | 210 | 179 | 63 |
| KLG-319C (latex CMC28442-34, St/MA/EA copolymer) | Potato | 28 | 54 | 7.3 (1.18) | 152 | 157 | 140 | 210 | 174 | 70 |
| KLG-322C (latex CMC28442-2, St/BzMA copolymer) | Potato | 33 | 54 | 7.8 (1.24) | 153 | 160 | 135 | 210 | 180 | 66 |
| KLG-324C (latex CMC28442-56, St/BA copolymer) | Potato | 32 | 53 | 6.8 (1.22) | 151 | 158 | 135 | >210 | 174 | 65 |
| KLG-354C (latex CMC28442-70, St/BA copolymer) | Potato | 24 | 57 | 6.8 (1.20) | 152 | 158 | 135 | 180 | 168 | 59 |
| TB-16624-1 Constellation polyester, 5% gel | Irregular | | | | 146 | 152 | 135 | >210 | 168 | 60 |

What is claimed is:

1. Toner comprising colorant and resin, said resin comprising a copolymer comprising styrene and an aromatic acrylic ester, wherein said aromatic acrylic ester is present in the copolymer in an amount of at least 30 weight percent based on the amount of monomers in the copolymer and is selected from the group consisting of benzyl acrylate, phenyl acrylate, phenylethyl acrylate, benzyl methacrylate and mixtures thereof.

2. Toner according to claim 1, wherein the resin is formed by emulsion aggregation.

3. Toner according to claim 1, wherein said styrene is present in the copolymer in an amount of from about 15 to about 70 weight percent of the copolymer.

4. Toner according to claim 1, wherein said copolymer further comprises at least one member selected from the group consisting of vinyl esters of aliphatic acids, ethylenically unsaturated carboxylic acids and cross-linking agents.

5. Toner comprising colorant and resin, said resin comprising a copolymer comprising styrene, aromatic acrylic ester and ethylenically unsaturated carboxylic acid, wherein said aromatic acrylic ester is present in the copolymer in an amount of at least 30 weight percent based on the amount of monomers in the copolymer.

6. Toner according to claim 5, wherein said aromatic acrylic ester is selected from the group consisting of benzyl acrylate, phenyl acrylate, phenylethyl acrylate, benzyl methacrylate and mixtures thereof.

7. Toner according to claim 5, wherein said styrene is present in the copolymer in an amount of from about 15 to about 70 weight percent of the copolymer.

8. Toner according to claim 5, wherein the resin is formed by emulsion aggregation.

* * * * *